US005667123A

United States Patent [19]

Fukuda

[11] Patent Number: 5,667,123

[45] Date of Patent: Sep. 16, 1997

[54] APPARATUS FOR CORRECTING ZIGZAG MOTION OF AN ELONGATED TRAVELING WEB

[75] Inventor: Masao Fukuda, Shiga, Japan

[73] Assignee: Ishida Co., Ltd., Kyoto, Japan

[21] Appl. No.: 584,993

[22] Filed: Jan. 11, 1996

Related U.S. Application Data

[63] Continuation of Ser. No. 155,971, Nov. 19, 1993, abandoned.

[30] Foreign Application Priority Data

Dec. 25, 1992 [JP] Japan ..... 4-359276

[51] Int. Cl.[6] ..... B65B 41/18; B65H 23/32; B65H 43/08

[52] U.S. Cl. ..... 226/21; 226/18

[58] Field of Search ..... 226/21, 19, 197, 226/199, 16, 17, 18

[56] References Cited

U.S. PATENT DOCUMENTS

| | | | |
|---|---|---|---|
| 3,225,988 | 12/1965 | Drenning | 226/19 |
| 3,467,292 | 9/1969 | Alexeff | 226/19 |
| 3,559,854 | 2/1971 | McArthur | 226/19 |
| 3,570,735 | 3/1971 | Kurz | 226/18 |
| 3,679,116 | 7/1972 | Hamlin et al. | 226/19 |
| 3,759,457 | 9/1973 | Enes et al. | 226/19 |
| 5,067,646 | 11/1991 | Young, Jr. et al. | 226/21 |
| 5,174,096 | 12/1992 | Fukuda | 53/551 |
| 5,199,351 | 4/1993 | Shibuya et al. | 226/197 |
| 5,308,010 | 5/1994 | Hakiel | 226/21 |
| 5,486,254 | 1/1996 | Gallagher et al. | 226/27 |

FOREIGN PATENT DOCUMENTS

| | | | |
|---|---|---|---|
| 601342 | 7/1960 | Canada | 226/19 |
| 0066444 | 5/1980 | Japan | 226/19 |
| 0179346 | 10/1984 | Japan | 226/197 |
| 2191608 | 5/1987 | United Kingdom . | |

*Primary Examiner*—Daniel P. Stodola
*Assistant Examiner*—Matthew A. Kaness
*Attorney, Agent, or Firm*—Majestic, Parsons, Siebert & Hsue

[57] ABSTRACT

An apparatus for correcting zigzag motion of a longitudinally traveling elongated sheet includes a forward signalling sensor on the travel path of the sheet and a first correction mechanism which is on the downstream side of, and is controlled by an open-loop method according to output signals from, this feed forward sensor to quickly correct the lateral displacement of the sheet. A second correction mechanism on the downstream side is controlled by output signals from a backward signalling sensor disposed further downstream thereto to correct by a closed-loop method the error in the correction effected by the first correction mechanism. If a significant trend of the sheet to move laterally in one direction is detected, parameters in the algorithm used by the first correction mechanism are adjusted.

20 Claims, 5 Drawing Sheets

APPARATUS FOR CORRECTING ZIGZAG MOTION OF AN ELONGATED TRAVELING WEB

This is a continuation of application Ser. No. 08/155,971 filed Nov. 19, 1993, now abandoned.

BACKGROUND OF THE INVENTION

This invention relates to apparatus for correcting zigzag motion of an elongated web, such as an elongated film or a sheet-like material, which is being transported longitudinally.

Consider, for example, a vertical pillow-type packaging machine having installed thereon a sheet roll with an elongated printed sheet wound therearound. Such a sheet is not always uniformly wound in the lateral direction because its thickness may not be uniform in the direction or there were variations in its tension when it was being wound. When such a sheet roll is set on a packaging machine and a sheet is pulled out of it, there may result a zigzag motion of the sheet, and the designs and characters printed on the produced bags may not match between the left-hand and right-hand halves. In order to prevent such occurrences, a mechanism may be used inclusive of a sensor placed along the travel path of the sheet and a correcting means placed on the upstream side of the sensor for shifting the sheet by a closed-loop correction algorithm. Such a mechanism as described, for example, in U.S. Pat. No. 4,049,213 may be effective if the irregularities in the winding of the rolled sheet vary relatively slowly. If the displacements of the sheet in the lateral direction vary significantly, however, there may be situations where a correction has already been effected by the correcting mechanism on the upstream side of the sensor by the time the displacement is detected at a downstream position. In other words, the zigzag motion of the web may become increased, instead of being reduced, such correction based on displacements detected on the downstream side.

SUMMARY OF THE INVENTION

The present invention has been accomplished in view of problems such as described above. It is therefore an object of the invention to provide a new apparatus for quickly and accurately correcting the zigzag motion of an elongated sheet caused, for example, by disarrangements in its winding around a film roll.

An apparatus embodying the present invention, with which the above and other objects can be accomplished, may be characterized as comprising a first correcting means, disposed on the travel path of a longitudinally travelling elongated web, for correcting its lateral displacements, such as a turn bar disposed diagonally to the travel path so as to change the direction of the travel path approximately by 90 degrees, and a forward signalling sensor means on the upstream side of the correcting means for detecting a lateral displacement of the web, the correction means changing by an open-loop method the lateral position of the web according to the outputs from the sensor means indicative of the measured displacement.

In order to further adjust the lateral displacements of the web, a second correcting means may be employed on the downstream side of the first correcting means. A backward signalling sensor means also for detecting a lateral displacement of the web is disposed on its downstream side such that adjustments of the lateral position of the web can be effected by a closed-loop method. Generally, corrections made by the second correcting means are smaller than those by the first correcting means. A trend control means may be provided for adjusting control parameters of the feed forward correcting means when the correction of the web position required of the second correcting means has grown and goes beyond its predetermined limits, indicating that there is a trend for the web to shift in one direction.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
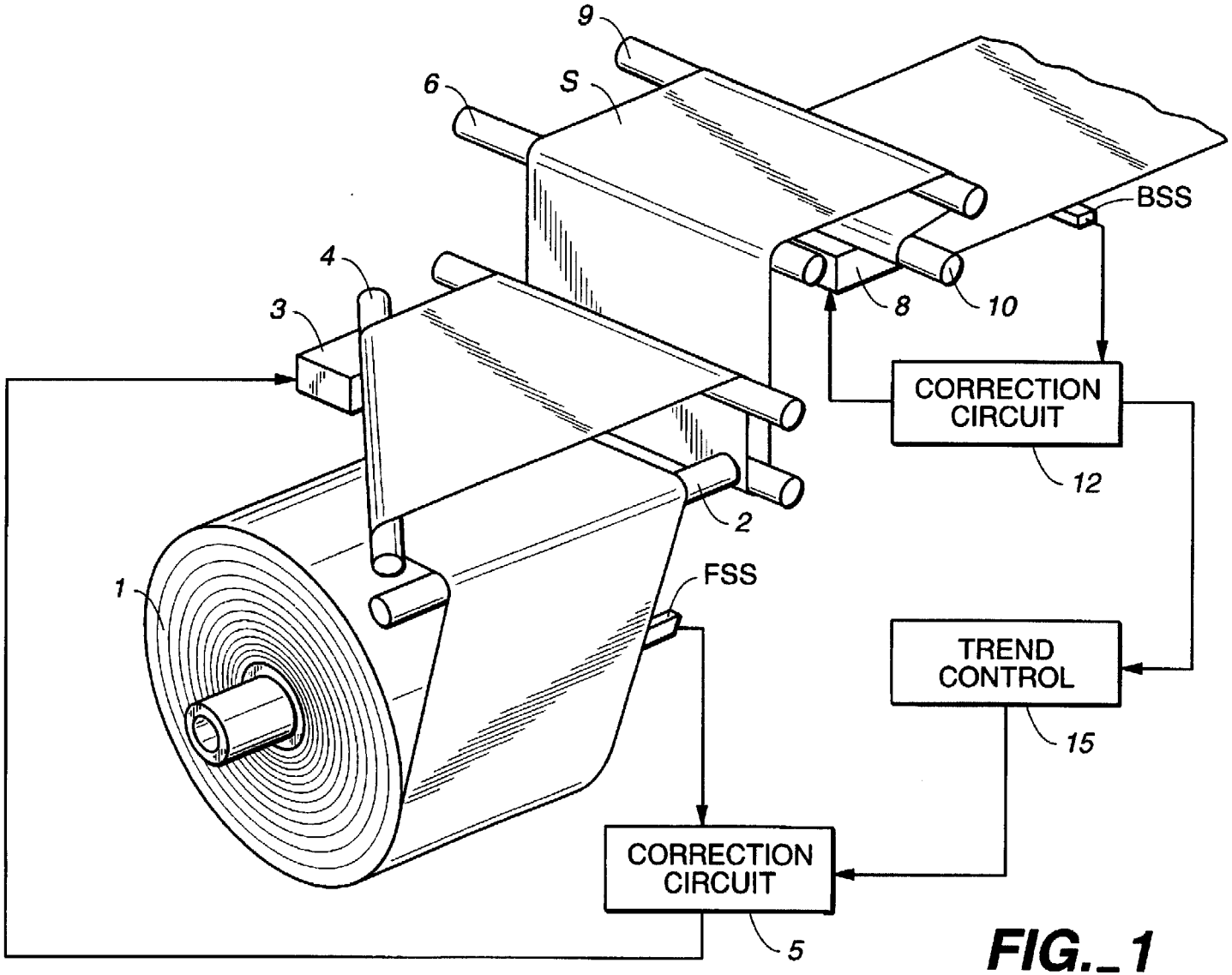
FIG. 1 is a schematic diagonal view of an apparatus embodying the present invention.

The invention will be described as applied to a bag maker-packaging machine of a so-called vertical pillow type (described, for example, in U.S. Pat. No. 5,174,096, to be herein incorporated by reference with reference to FIG. 1 wherein numeral 1 indicates a sheet roll. An elongated web of sheet S, pulled out of this sheet roll 1, is transported longitudinally by means of a guide roll 2 extending parallel to the axis of the sheet roll 1 and a turn bar 4 which is disposed diagonally thereto. The turn bar 4 is for changing the direction of motion of the sheet S approximately by 90 degrees so as to head towards the former (not shown) of the bag maker for forming the sheet S into a tubular shape before bags are made therefrom. The turn bar 4 is provided with a first correction mechanism 3 such as a servo motor so as to be able to move translationally, that is, moving laterally without changing its direction of extension. When a sheet roll of a different width is loaded, the position of the turn bar 4 is thereby adjusted such that the center line of the sheet will correctly align with the former to which it is directed. The sheet S is further passed over a guide roll 6 and through a pair of somewhat obliquely disposed correction rolls 9 and 10, which serves as a second correcting means, and then guided to a bag maker-packaging machine (not shown).

Figure 2:
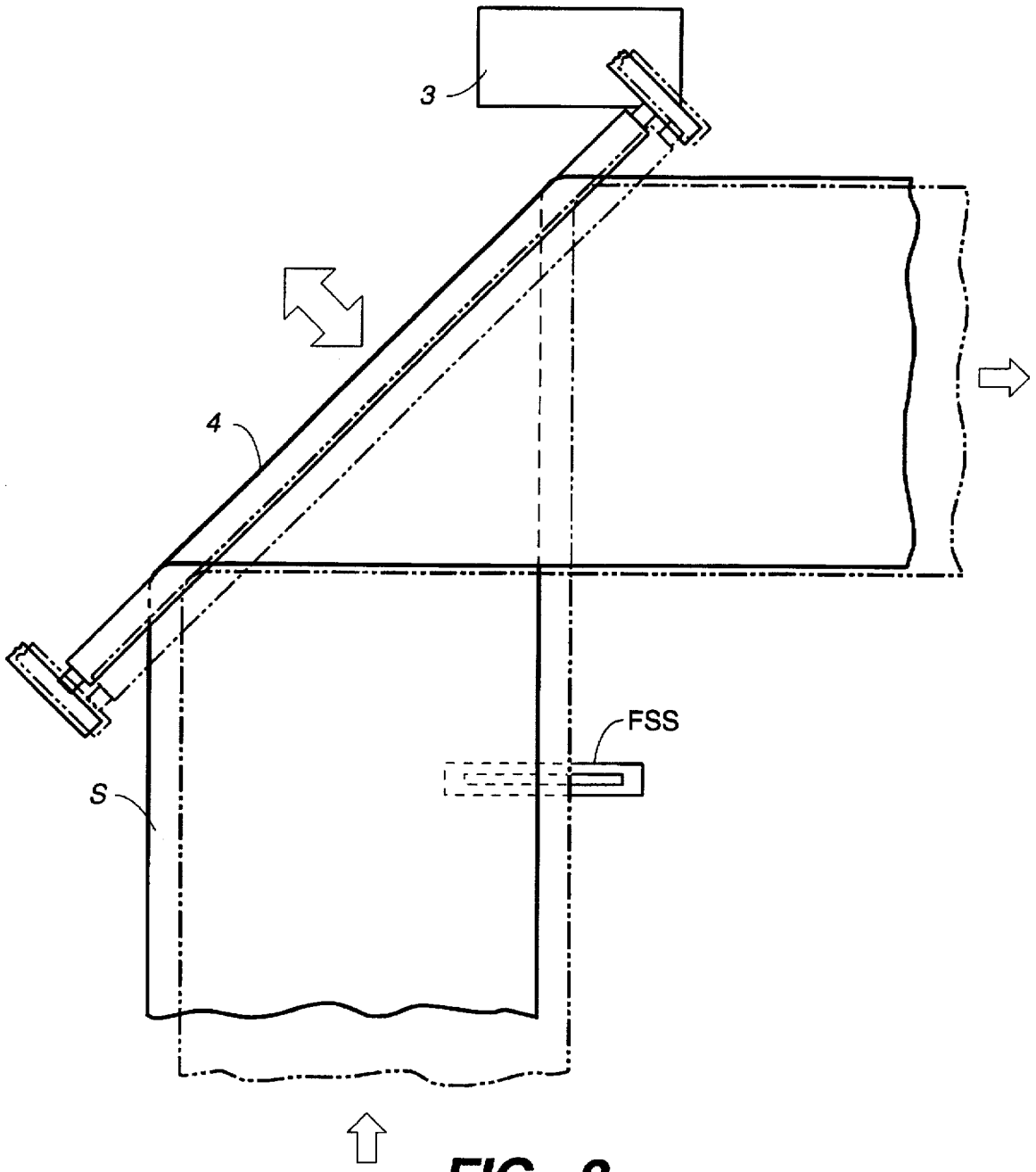
FIG. 2 is a diagram for showing the function of the first correcting means.

FIG. 2 shows how the turn bar 4 can adjust lateral displacements of the sheet S by moving translationally, as explained above, by means of the first correction mechanism 3. A forward signalling sensor FSS is disposed upstream of the first correction mechanism 3 along the travel path of the sheet S for detecting the lateral displacement of the sheet S at its position and outputting a signal indicative of the detected displacement. Numeral 5 (shown in FIG. 1) indicates a first control circuit adapted to control the first correction mechanism 3 according to this output signal from the forward signalling sensor FSS.

With an apparatus thus structured, if the sheet S was not uniformly wound in the sheet roll 1 and undergoes a zigzag motion, moving back and forth transversely to the direction in which it is pulled, the forward signalling sensor FSS, disposed on the upstream side of the first correction mechanism 3, detects it as a deviation from a target position (indicated by x in FIG. 4) and successively outputs signals each indicating the magnitude of the displacement from the target position x at the moment. These signals are received by the first correction circuit 5 for controlling the first correction mechanism 3 by an open-loop control method and causing the turn bar 4 to move laterally as explained above to correct the transverse displacements of the sheet S due to its zigzag motion.

Figure 3:
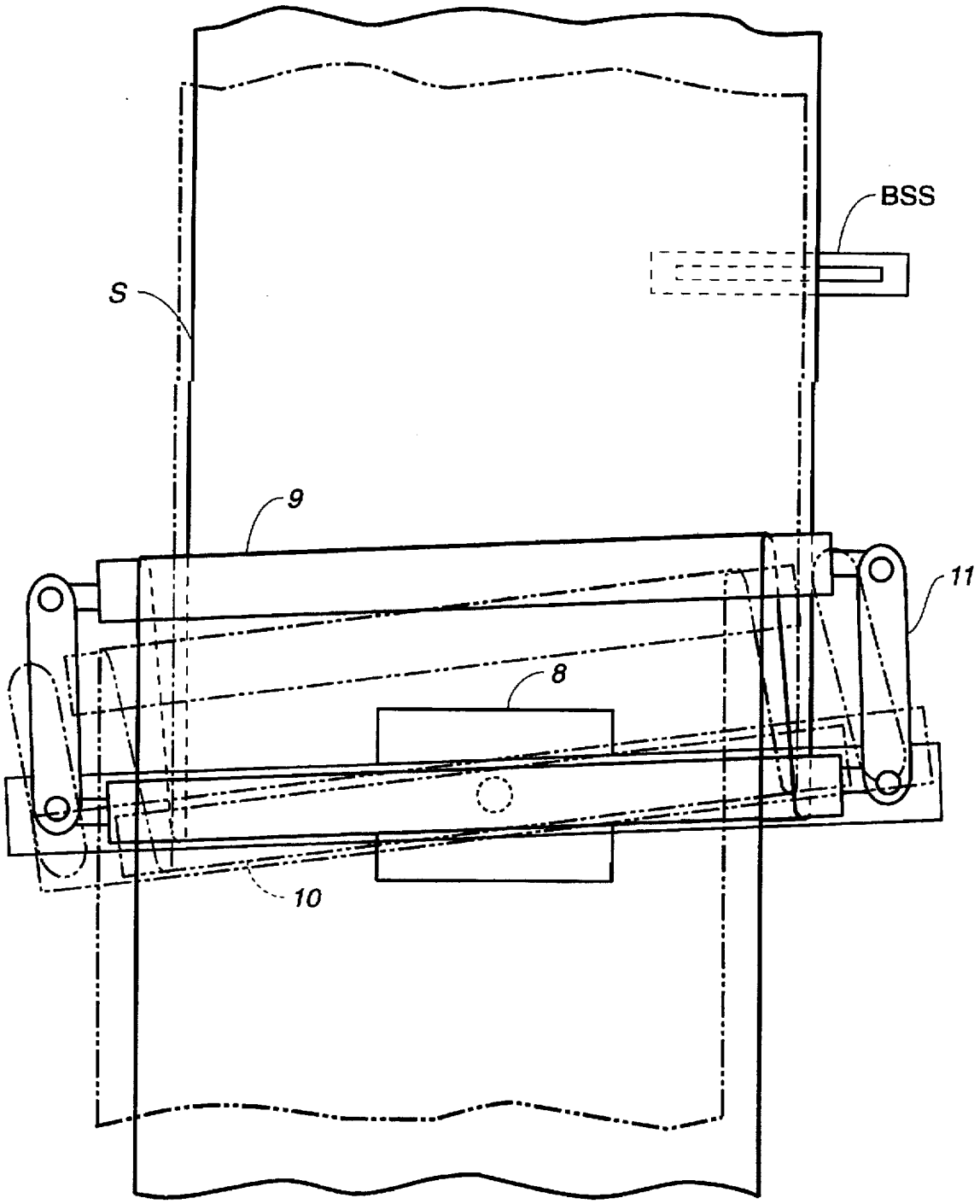
FIG. 3 is a diagram for showing the function of the second correcting means.

The correction thus made, as described above, is primarily of zigzag motion caused by the non-uniform way in which the sheet roll 1 has been wound. There are other causes, however, of the zigzag motion of the sheet S such as external disturbances. The aforementioned second correcting means, including the pair of correction rolls 9 and 10, is for correcting the zigzag motion due to such other causes. As shown in FIG. 3, the correction rolls 9 and 10 are for correcting lateral displacements of the sheet S by means of a second correction mechanism 8 of a kind disclosed, for example, in Japanese Patent Publication Tokkai 4-144871. This is to say that the second correction mechanism 8 may be so structured that a transverse displacement of the sheet S is corrected by tilting links 11 for forming a parallelogram with the correction rolls 9 and 10 according to a detection signal outputted from a backward signalling sensor BSS which is disposed on the downstream side of the correction rolls 9 and 10 with respect to the direction of travel of the sheet S. Numeral 12 indicates a second control circuit adapted to control the second correction mechanism 8 according to this output signal from the backward signalling sensor BSS.

Figure 4:
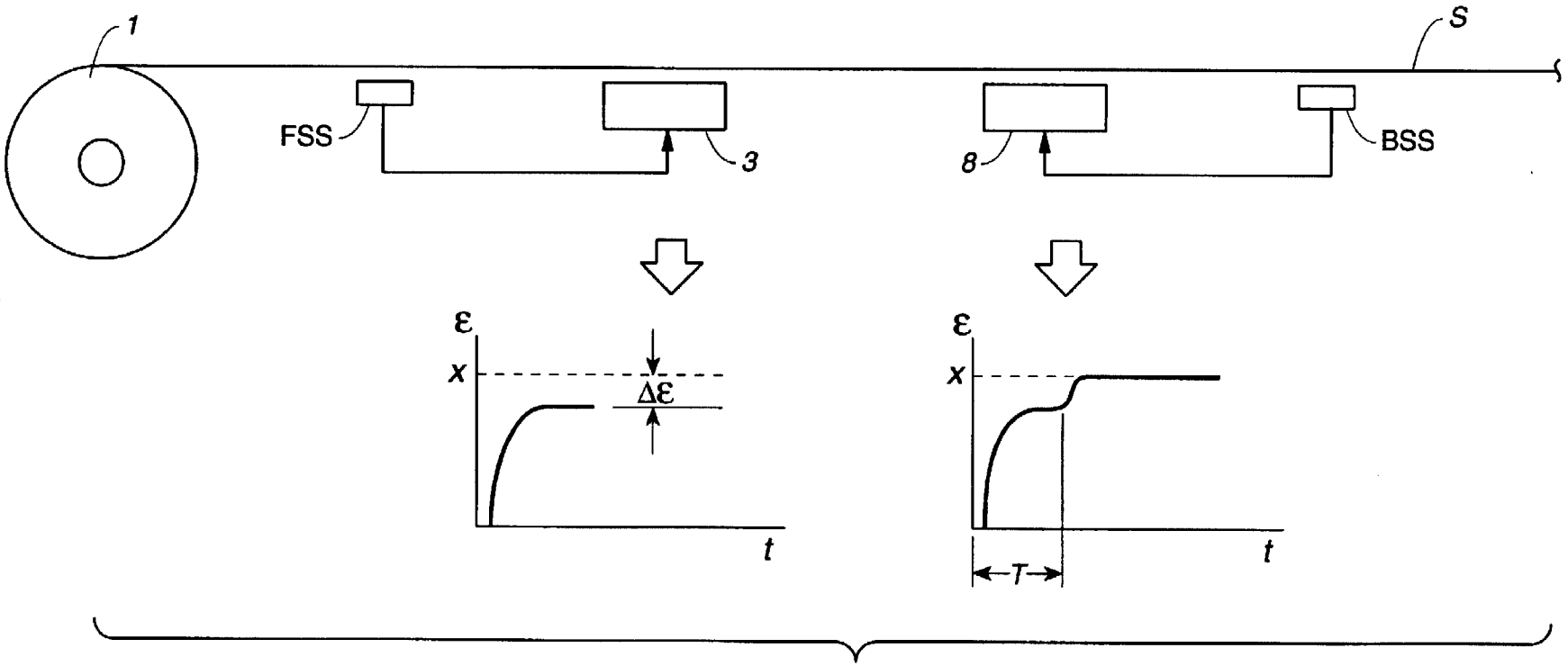
FIG. 4 is a schematic for showing the positional relationship of the components of the apparatus of FIG. 1 and their roles played in correcting the position of the sheet.

The correction of a zigzag motion by the first and second correction mechanisms 3 and 8 is schematically illustrated in FIG. 4 wherein the position of the sheet S in the direction transverse to its travel path is indicated by symbol $\epsilon$ as a function of time t. As explained above, the correction made by the first correction mechanism may include a small error $\Delta\epsilon$ due, for example, to external disturbances. As the sheet S reaches the position of the backward signalling sensor BSS on the downstream side of the second correction mechanism 8 (and preferably immediately before the sheet S reaches the former), the lateral displacement of the sheet S corresponding to this error $\Delta\epsilon$ is detected (after the time T taken by the sheet S to travel the distance between the sensors FSS and BSS), and a signal indicative of this displacement is outputted to the second correction circuit 12, which controls the second correction mechanism 8 by a closed-loop method and thereby rotates the correction rolls 9 and 10 by an angle corresponding to the required correction so as to bring the sheet S accurately to the target position.

Figure 5:
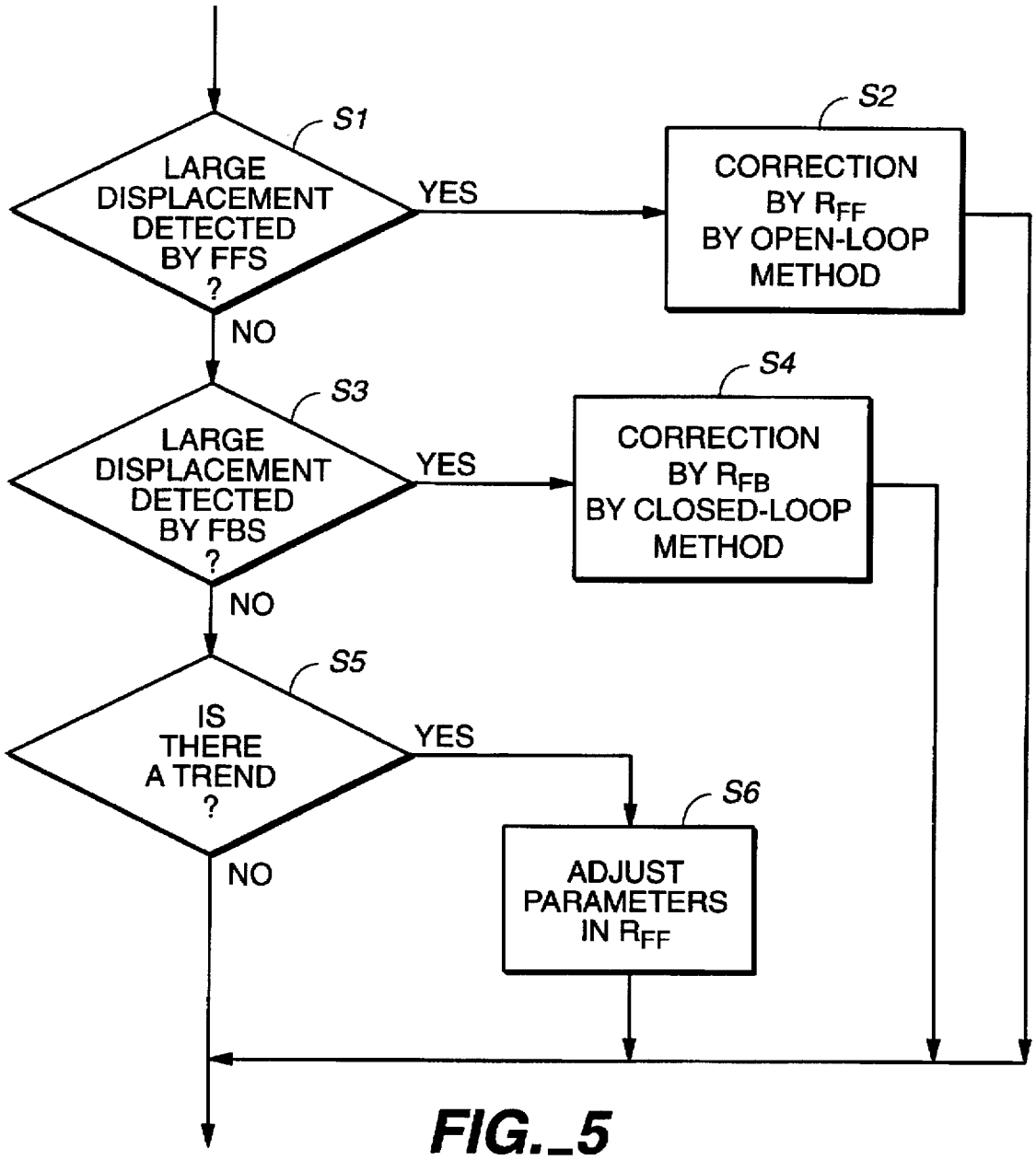
FIG. 5 is a schematic flow chart for the operation of the apparatus of FIG. 1.

In FIG. 1, numeral 15 indicates a trend control means, representing another aspect of the invention, for coordinating the operations of the first and second correction circuits 5 and 12 where corrections by the second correction mechanism 8 are usually much smaller than those by the first correction mechanism 3. As shown in FIG. 5 which schematically illustrates the operations of the apparatus of FIG. 1 including the trend control means 15, the first and second correction circuits 5 and 12 use preset open-loop and closed-loop algorithms (symbolically represented by $R_{FF}$ and $R_{FB}$, respectively) to operate the first and second correction mechanisms 3 and 8, (Steps S2 and S4), respectively, if the displacement detected by the FSS and BSS sensors are greater than a certain threshold value (YES in Steps S1 and S3, respectively). If the correction to be effected by the second correction mechanism 8, corresponding to a detection signal outputted from the backward signalling sensor BSS, is outside its limit of control, the trend control means 15 interprets it as a trend for the sheet S to move more in one direction than in the other (YES in Step S5) and adjusts parameters which define the algorithm $R_{FF}$ by which the first correction circuit 5 controls the first correction mechanism 3 corresponding to a detection signal outputted from the forward signalling sensor FSS (Step S6).

Although the present invention has been described above as applied to a sheet transporting device for a packaging machine, apparatus for correcting the zigzag motion of a web according to the present invention can also be used, for example, with a device for supplying paper to a printing machine using an elongated web.

In summary, zigzag motions of a longitudinally traveling web of sheet are corrected according to the present invention by detecting the transverse displacement of the sheet at an upstream position and making a correction by an open-loop method according to the magnitude of the detected displacement by a correcting means disposed on the downstream side of the sensor which detected the displacement. There may also be provided a second correcting mechanism operating on a backward signalling principle with a correcting means and a detection sensor disposed on the downstream side of the correcting means such that the correcting means based on the forward signalling principle can quickly correct the displacement of the web by an open-loop method, and the correcting means on the downstream side makes an additional correction by a closed-loop method.

What is claimed is:

1. An apparatus for correcting zigzag motion of an elongated web being transported longitudinally along a path, said apparatus comprising:

first correcting means, disposed on said path, for correcting lateral displacements of said web;

forward-signalling sensor means, disposed on said path on the upstream side of said first correcting means, for detecting and outputting signals indicative of lateral displacements of said web at said forward-signalling sensor means;

first control means for receiving signals from said forward-signalling sensor means and controlling operations of said first correcting means according to said signals received from said forward-signalling sensor means;

second correcting means, disposed on said path and on the downstream side of said first correcting means, for correcting lateral displacements of said web at said second correcting means;

backward-signalling sensor means, disposed on said path on the downstream side of said second correcting means, for detecting and outputting signals indicative of lateral displacements of said web at said backward-signalling sensor means;

second control means for receiving signals from said backward-signalling sensor means and controlling operations of said second correcting means according to said signals received from said backward-signalling sensor means; and trend control means for receiving outputs from said backward-signalling sensor means through said second control means and controlling said first control means automatically without affecting preset parameters of said second control means by using said outputs in a preset algorithm.

2. The apparatus of claim 1 wherein said first correcting means include an elongated member disposed diagonally to said path and serving to change the direction of motion of said elongated web approximately by 90 degrees, said elongated member being adapted to move translationally according to a signal from said first control means.

3. The apparatus of claim 1 wherein said second control means controls said second correcting means by a closed loop correction method.

4. The apparatus of claim 3 wherein said first control means controls said first correcting means by an open loop correction method.

5. The apparatus of claim 1 wherein said first control means controls said first correcting means by an open loop correction method.

6. The apparatus of claim 1 wherein said trend control means use said preset algorithm to adjust control parameters used by said first control means when outputs from said backward-signalling means indicate that the correction to be effected by said feedback correcting means corresponding to said outputs is beyond limits of said second means.

7. The apparatus of claim 6 wherein said first correcting means include an elongated member disposed diagonally to said path and serving to change the direction of motion of said elongated web approximately by 90 degrees, said elongated member being adapted to move translationally according to a signal from said first control means.

8. The apparatus of claim 6 wherein said second control means controls said second correcting means by a closed loop correction method.

9. The apparatus of claim 8 wherein said first control means controls said first correcting means by an open loop correction method.

10. The apparatus of claim 1 wherein said first correcting means is controlled only by said first control means and said second correcting means is controlled only by said second control means.

11. An apparatus for correcting zigzag motion of an elongated web being transported longitudinally along a path, said apparatus comprising:

first correcting means, disposed on said path, for correcting lateral displacements of said web;

forward-signalling sensor means, disposed on said path on the upstream side of said first correcting means, for detecting and outputting signals indicative of lateral displacements of said web at said forward-signalling sensor means;

first control means for receiving signals from said forward-signalling sensor means and controlling operations of said first correcting means by using said signals received from said forward-signalling sensor means in a preset control algorithm which contains parameters;

second correcting means, disposed on said path and on the downstream side of said first correcting means, for correcting lateral displacements of said web at said second correcting means;

backward-signalling sensor means, disposed on said path on the downstream side of said second correcting means, for detecting and outputting signals indicative of lateral displacements of said web at said backward-signalling sensor means;

second control means for receiving signals from said backward-signalling sensor means and controlling operations of said second correcting means according to said signals received from said backward-signalling sensor means but without regard to any outputs from said first control means; and trend control means having a preset trend control algorithm for receiving outputs from said backward-signalling sensor means through said second control means and automatically controlling said first control means without affecting preset parameters of said second control means by adjusting said parameters of said control algorithm of said first control by using said outputs in said preset trend control algorithm.

12. The apparatus of claim 11 wherein said first correcting means include an elongated member disposed diagonally to said path and serving to change the direction of motion of said elongated web approximately by 90 degrees, said elongated member being adapted to move translationally according to a signal from said first control means.

13. The apparatus of claim 11 wherein said second control means controls said second correcting means by a closed loop correction method.

14. The apparatus of claim 13 wherein said first control means controls said first correcting means by an open loop correction method.

15. The apparatus of claim 11 wherein said first control means controls said first correcting means by an open loop correction method.

16. The apparatus of claim 11 wherein said trend control means uses said preset trend control algorithm to adjust control parameters used by said first control means when outputs from said backward-signalling means indicate that the correction to be effected by said feedback correcting means corresponding to said outputs is beyond limits of said second means.

17. The apparatus of claim 16 wherein said first correcting means include an elongated member disposed diagonally to said path and serving to change the direction of motion of said elongated web approximately by 90 degrees, said elongated member being adapted to move translationally according to a signal from said first control means.

18. The apparatus of claim 16 wherein said second control means controls said second correcting means by a closed loop correction method.

19. The apparatus of claim 18 wherein said first control means controls said first correcting means by an open loop correction method.

20. The apparatus of claim 11 wherein said first correcting means is controlled only by said first control means and said second correcting means is controlled only by said second control means.

* * * * *